US007661173B2

(12) United States Patent
Amos

(10) Patent No.: US 7,661,173 B2
(45) Date of Patent: Feb. 16, 2010

(54) METHOD AND APPARATUS FOR CLEANING HOOK AND LOOP ATTACHMENT MATERIALS

(76) Inventor: Pamela Louise Amos, 4 Scarborough Court, Wynn Vale, South Australia 5127 (AU)

( * ) Notice: Subject to any disclaimer, the term of this patent is extended or adjusted under 35 U.S.C. 154(b) by 845 days.

(21) Appl. No.: 10/508,900

(22) PCT Filed: Mar. 25, 2003

(86) PCT No.: PCT/AU03/00354

§ 371 (c)(1),
(2), (4) Date: Sep. 23, 2004

(87) PCT Pub. No.: WO03/079880

PCT Pub. Date: Oct. 2, 2003

(65) Prior Publication Data

US 2005/0178403 A1 Aug. 18, 2005

(30) Foreign Application Priority Data

Mar. 25, 2002 (AU) ..... PS1310

(51) Int. Cl.
*A47L 13/12* (2006.01)
*A46B 17/06* (2006.01)

(52) U.S. Cl. ..... 15/142; 15/143; 15/236.06; 134/6

(58) Field of Classification Search ..... 15/142, 15/143–146, 236.06, 236.08; 134/6
See application file for complete search history.

(56) References Cited

U.S. PATENT DOCUMENTS

| | | | | | |
|---|---|---|---|---|---|
| 191,608 | A * | 6/1877 | Miller | 119/617 |
| 671,047 | A * | 4/1901 | Fox | 401/28 |
| 1,008,382 | A * | 11/1911 | Sourek | 15/197 |
| 1,600,368 | A * | 9/1926 | Skoglund | 15/160 |
| 2,564,721 | A * | 8/1951 | Raya | 15/142 |
| 3,053,264 | A * | 9/1962 | Breton | 132/116 |
| 3,170,182 | A * | 2/1965 | Burian | 15/142 |
| 3,744,082 | A * | 7/1973 | Marshall | 15/402 |
| 3,838,474 | A * | 10/1974 | Erickson | 15/142 |
| 3,999,244 | A * | 12/1976 | Brickley | 15/142 |
| D249,750 | S * | 10/1978 | Erickson | D4/136 |
| D262,671 | S * | 1/1982 | Erickson | D4/136 |
| 5,297,882 | A * | 3/1994 | Kornides | 401/184 |
| 5,922,139 | A | 7/1999 | Gilbert | |
| 6,264,755 | B1 * | 7/2001 | Georgiou | 134/6 |
| 2005/0178403 | A1 * | 8/2005 | Amos | 134/6 |

FOREIGN PATENT DOCUMENTS

AU 200013479 B2 3/2000

* cited by examiner

*Primary Examiner*—Lee D Wilson
(74) *Attorney, Agent, or Firm*—Craig A. Fieschko, Esq.; DeWitt Ross & Stevens S.C.

(57) ABSTRACT

An apparatus (1) and method for restoration of hook/loop attachment materials (8) which apparatus (1) includes a rake with a set of teeth (2) that match the separation widths of rows of the hooks of the attachment materials. There is also disclosed a second set of teeth (3) that are aligned behind the first set (2) to typically pick up debris lifted but not removed by the first set of teeth (2)

18 Claims, 8 Drawing Sheets

METHOD AND APPARATUS FOR CLEANING HOOK AND LOOP ATTACHMENT MATERIALS

TECHNICAL FIELD

This invention relates to a cleaning method and means particularly related to a joining technique commonly described as a loop and hook system and otherwise recognized by use of the Trade Mark "Velcro".

Such hook and loop joining systems are now commonly used in a large number of applications.

The problem to which this invention is directed relates to many of those applications where, after a period of usage, the material becomes less useful and the joining strength available from the material is degraded.

After researching this problem, I have discovered that at least one of the problems relating to this degradation is the fact that the hook side of the attachment materials has debris which are captured thereby such that the hooks either are filled with such debris, or there are fewer hooks available to capture loops.

In a number of applications, this then results in expensive articles having to be discarded.

I have discovered, in accordance with this invention, that the hook material can be cleared or cleaned of such debris such that there is at least a substantial return to original effectiveness of the strength of attachment available between the hook and loop materials.

DISCLOSURE OF THE INVENTION

It is then an object of this invention to propose both a method to effect a restoration of the attachment strength and appearance between hook and loop attachment materials and also, in a further form of the invention, to provide an apparatus to assist.

In one form of this invention then although this need not necessarily be the only or indeed the broadest form of this, there is proposed a method restoration of hook to loop attachment materials which method includes the steps of effecting a raking or scooping of the hook material with a member having a plurality of spaced apart teeth where the width of each respective tooth and the spacing apart of adjacent teeth is such that each respective teeth is adapted to pass together with the other teeth between adjacent hooks on the hook material.

The discovery is, of course, that a number of materials are implicitly captured by the hooks of the hook material.

The hooks are formed from resilient materials and include a stem which is anchored on a flexible sheet of material with the top of the stem being curved so as to form a hook shape.

This description is provided of existing hook like material as is conventionally sold and now widely used under the Trade Mark "Velcro".

It has been noticed that such hook material has each of the stems supported in a repeated parallel alignment with the hook extending into a row preceding the next line of stems with their own hooks.

If any attempt is made to "clean" this material, for instance, using the blade of a scraper, the stems themselves in one direction will, in a sense, divert any blade from engaging and enabling, therefore, any lift away of debris.

It has been discovered that the hook material has respective stems which are spaced apart a relatively uniform distance which is 0.8 mm in a typical case.

Allowing for the thickness of each stem, the distance between respective stems is therefore smaller than this but if a raking apparatus is prepared where the distance apart between respective is at least the thickness of a respective stem and the width of each respective tooth is less than the width apart of immediately adjacent stems in the material, then we have for the first time the ability to protrude into debris and lift this past capturing hooks.

A raking member is assisted by having a leading edge which is of wedge shape and such that a lowermost edge is forwardmost providing thereby a relatively thin lowermost edge for purging into the hook captured debris material.

In preference, the front shape of each respective tooth also includes, when viewed in plan, a tapered shape.

In preference, such tapered shape includes a medial forwardmost point with respective sides inclined away from such forward point.

One of the difficulties with the arrangement now described is that some of the debris that has been discovered can be caught comprises fine threads, lint, cotton materials and the like.

If a single pass is then effected with a single row of teeth in accordance with this description so far, then while some of the debris is lifted, a lot of it is either broken by this first pass and is therefore left even though partially dislodged.

It has been found to be of significant advantage to have a second line of teeth aligned and shaped and having the same general characteristics as a first line of teeth so that the raking apparatus then is characterized by having two lines of teeth in echelon.

The advantage has been discovered in this that with the first pass then considerably more material is lifted and captured where the first line of teeth partially lift, the second line of teeth engage further and can lift out fully the debris in practical circumstances.

In each case, the invention can reside in an apparatus for restoration of hook/loop attachment materials of the type conventionally sold under the Trade Mark "Velcro" where there is a rake comprised of a plurality of teeth aligned in side by side alignment, each of the teeth being separated by an adjacent tooth with a gap that is at least the width of a respective stem of each of the hooks, and where the width of each respective tooth is the same and is less than the distance between respective stems.

In preference, the leading edge of such respective teeth in each case includes a lowermost narrow edge with a body of the tooth providing then a forward wedge shape.

In preference, the leading edge of each respective tooth is tapered both when viewed from a side and when viewed in plan.

In preference, there are at least two sets of such teeth held so that they will then define between respective teeth the width of a respective stem of the hook material, and where each of the teeth is of a width that will pass between respective stems.

In preference, the rake is formed from plastics material and is such that the gap between respective teeth has a length that is relatively short so as to provide significant strength to each forwardly projecting portion of each tooth.

BRIEF DESCRIPTION OF THE DRAWINGS

For a better understanding of this invention it will now be described with reference to an embodiment which shall be described with the assistance of drawings wherein:

FIG. 1 (*b*) is a perspective view of the preferred embodiment illustrating an alternative way of using it;

FIG. 3(*b*) is the view from the underside of that same embodiment;

BEST MODE FOR CARRYING OUT THE INVENTION

Figure 1A:
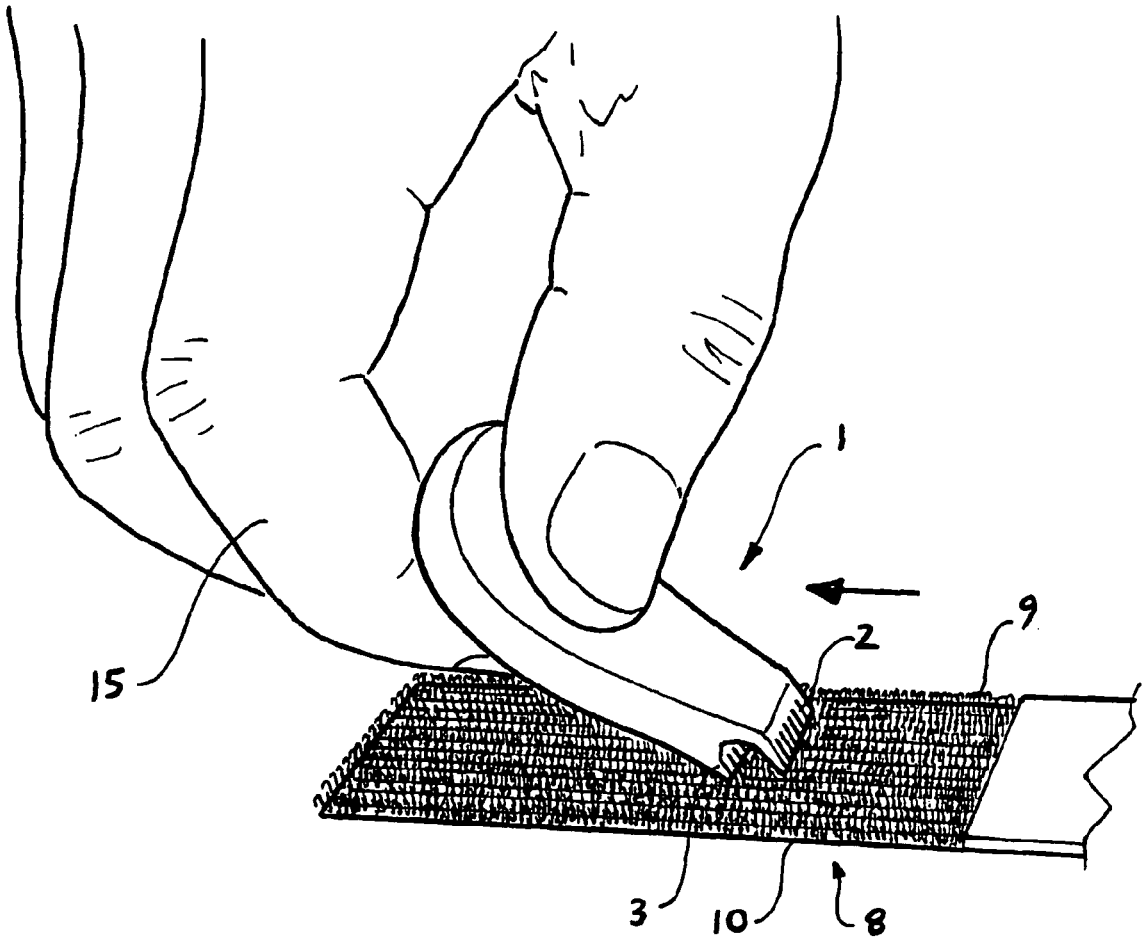
FIG. 1 (*a*). is a perspective view of the preferred embodiment illustrating the way in which it is used.
Figure 1B:
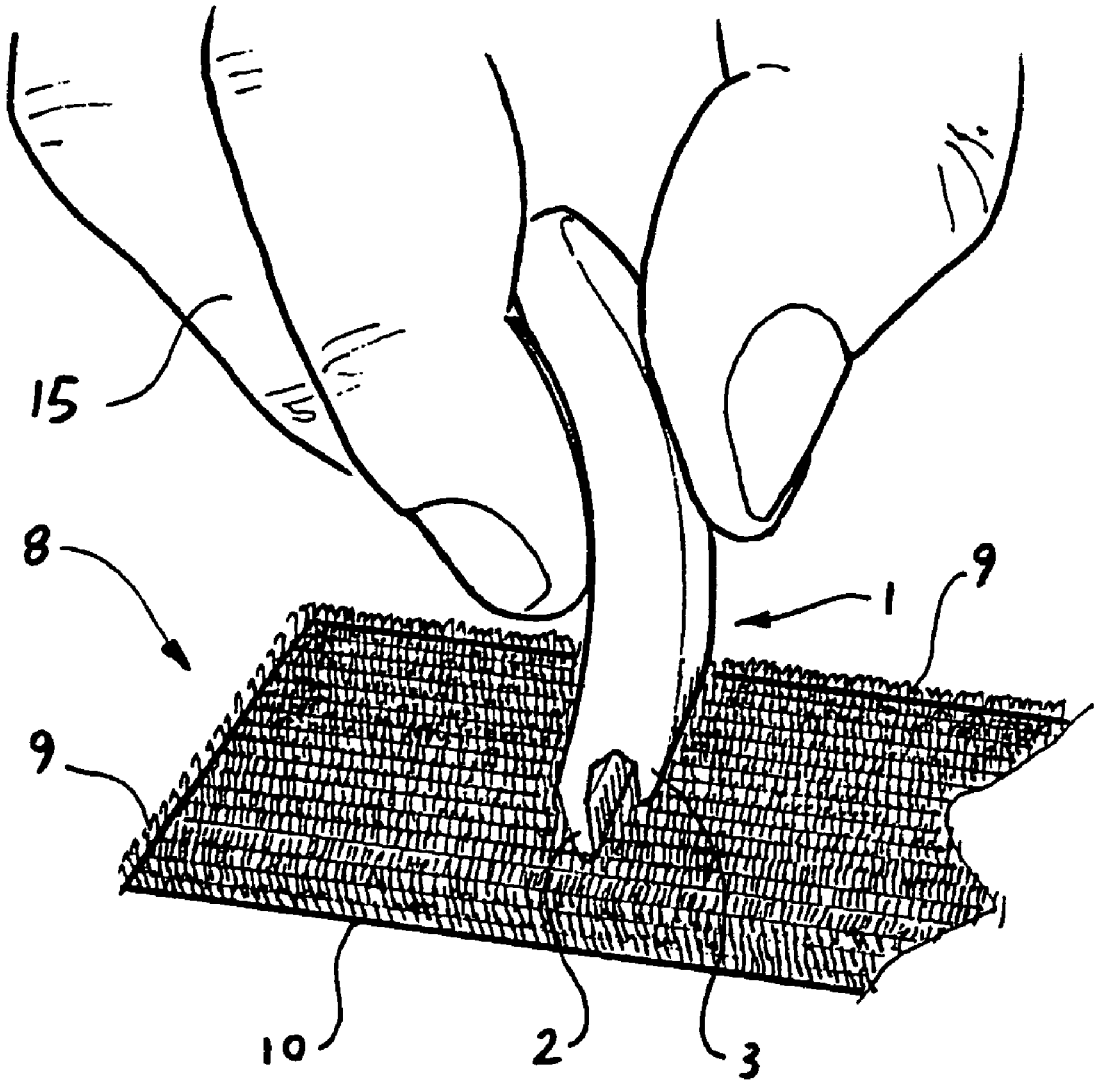
Figure 2:
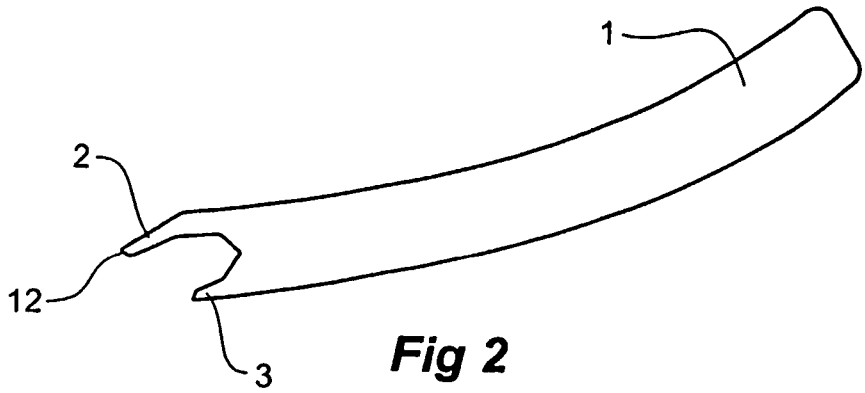
FIG. 2 is a side elevation of that same embodiment.
Figure 3A:
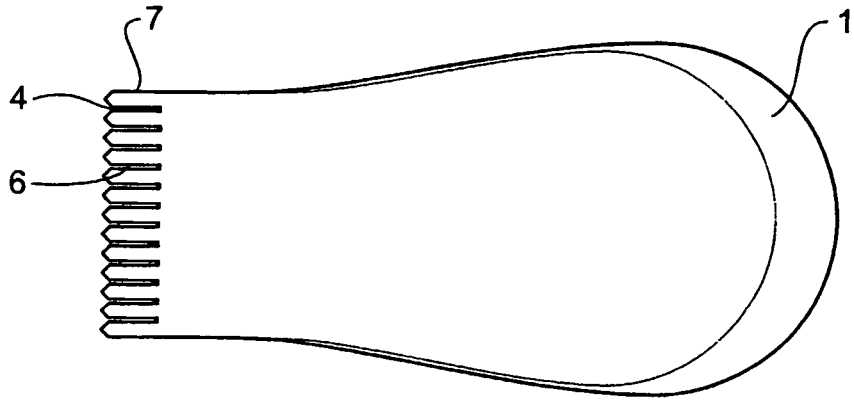
FIG. 3(*a*) is a plan view of that same embodiment.
Figure 3B:
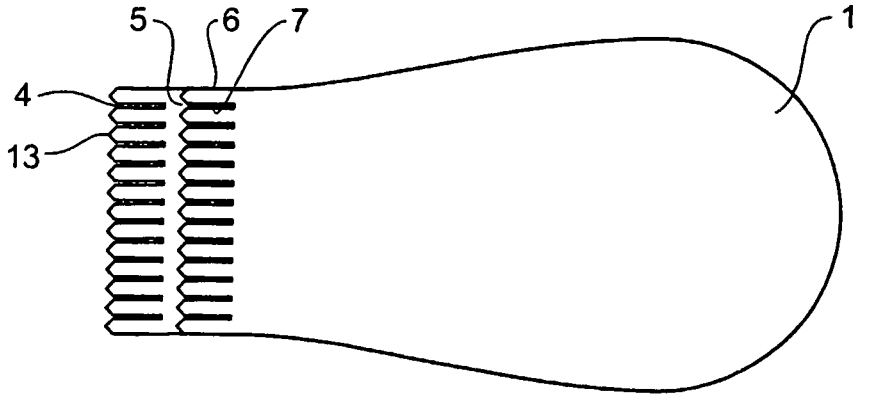
Figure 4:
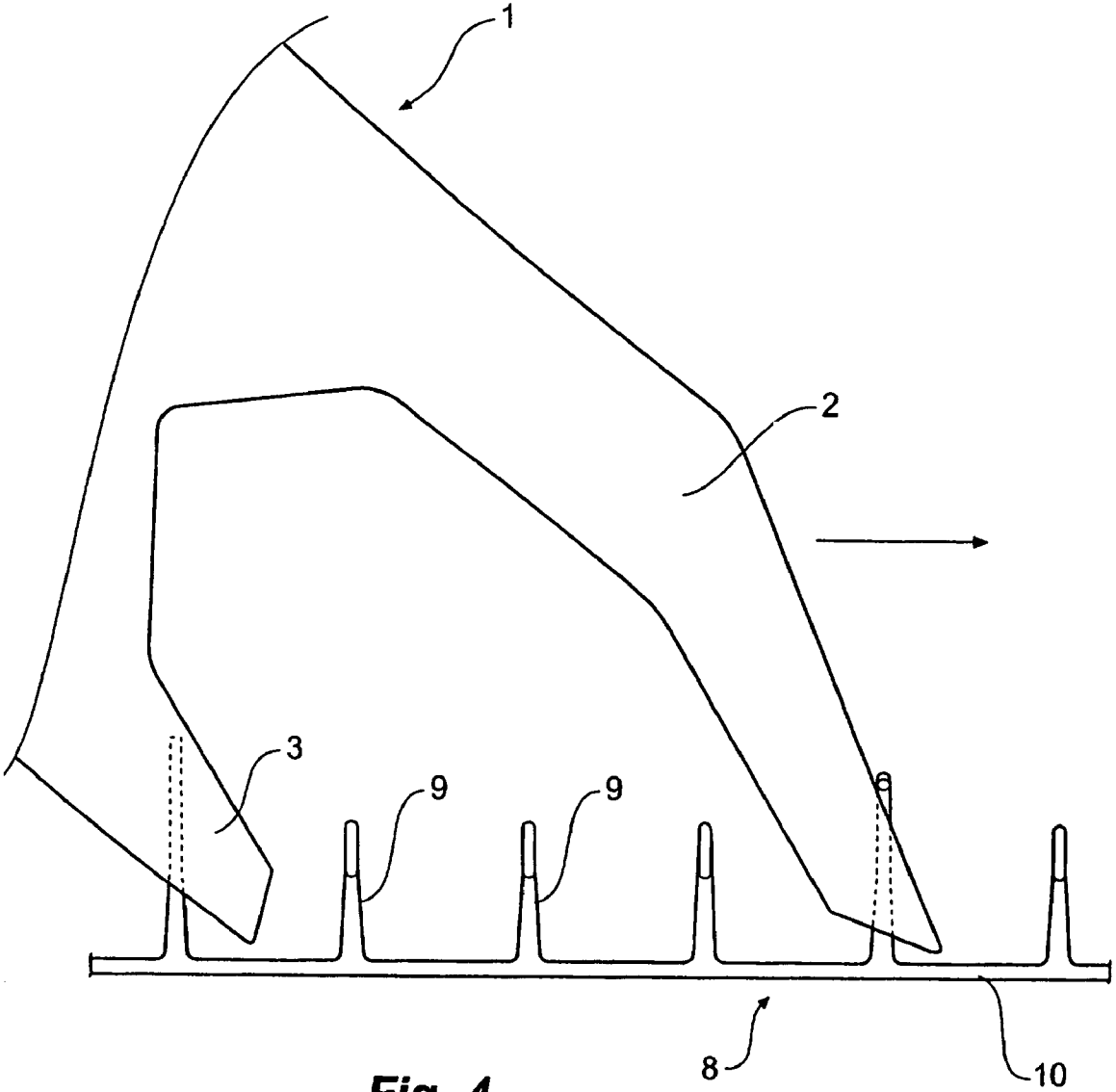
FIG. 4 is a detail side view, illustrating the way in which the embodiment is used with the hook side of a hook and loop attachment system.
Figure 5:
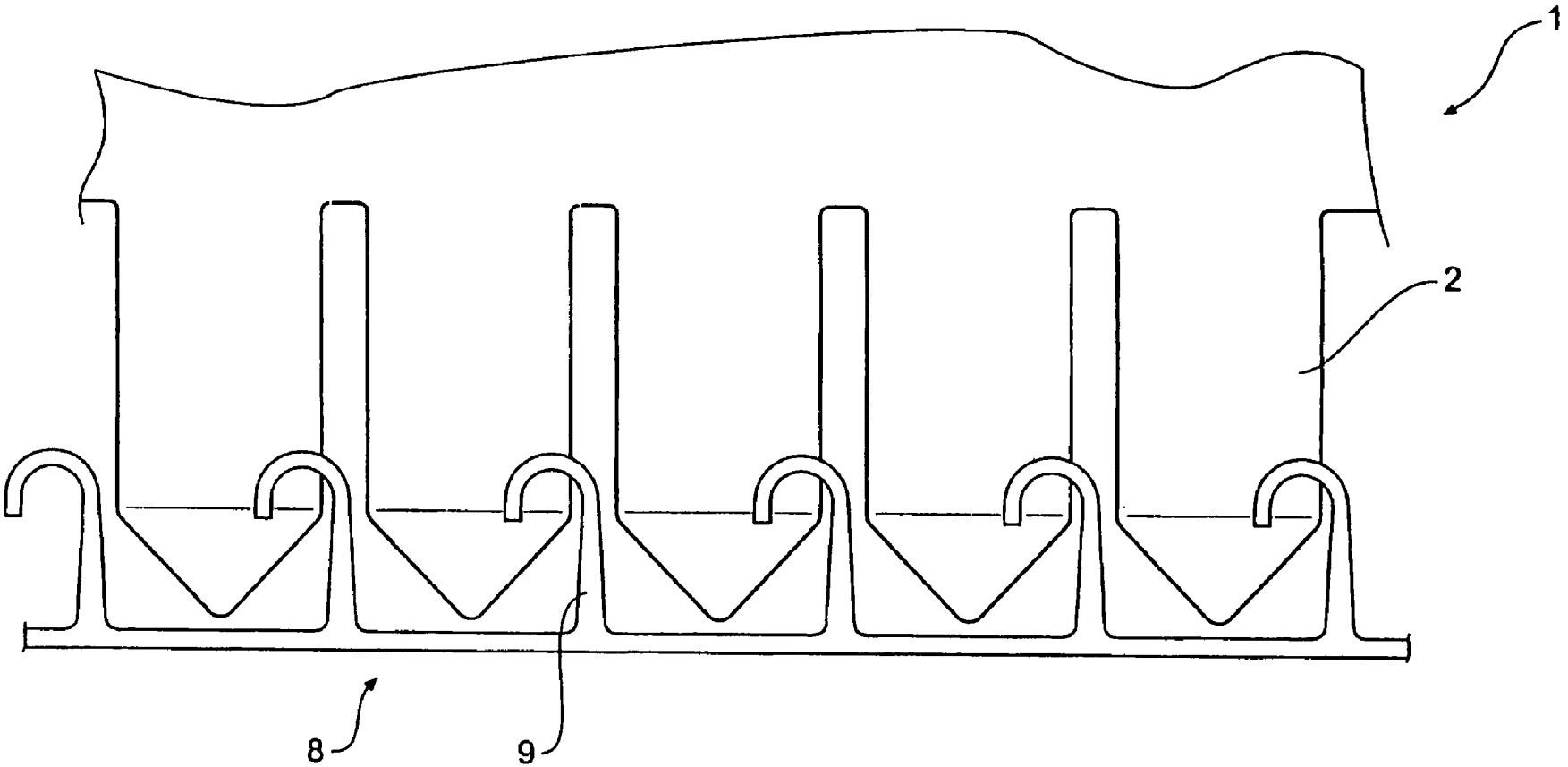
FIG. 5 is a detail front view, illustrating the way in which the embodiment is used with the hook side of a hook and loop attachment system.
Figure 6:
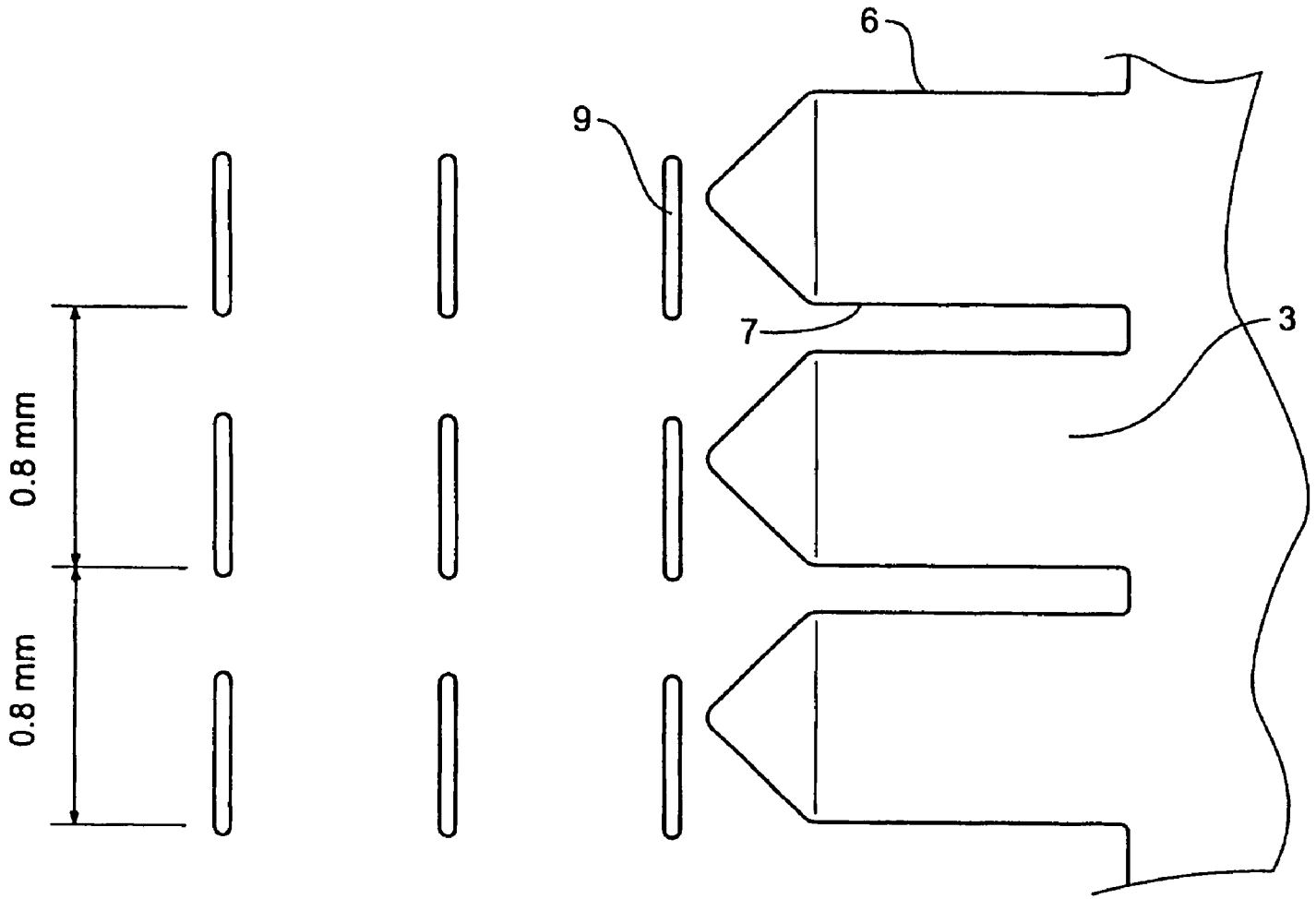
FIG. 6 is a detail plan view, illustrating the way in which the embodiment is used with the hook side of a hook and loop attachment system.
Figure 7:
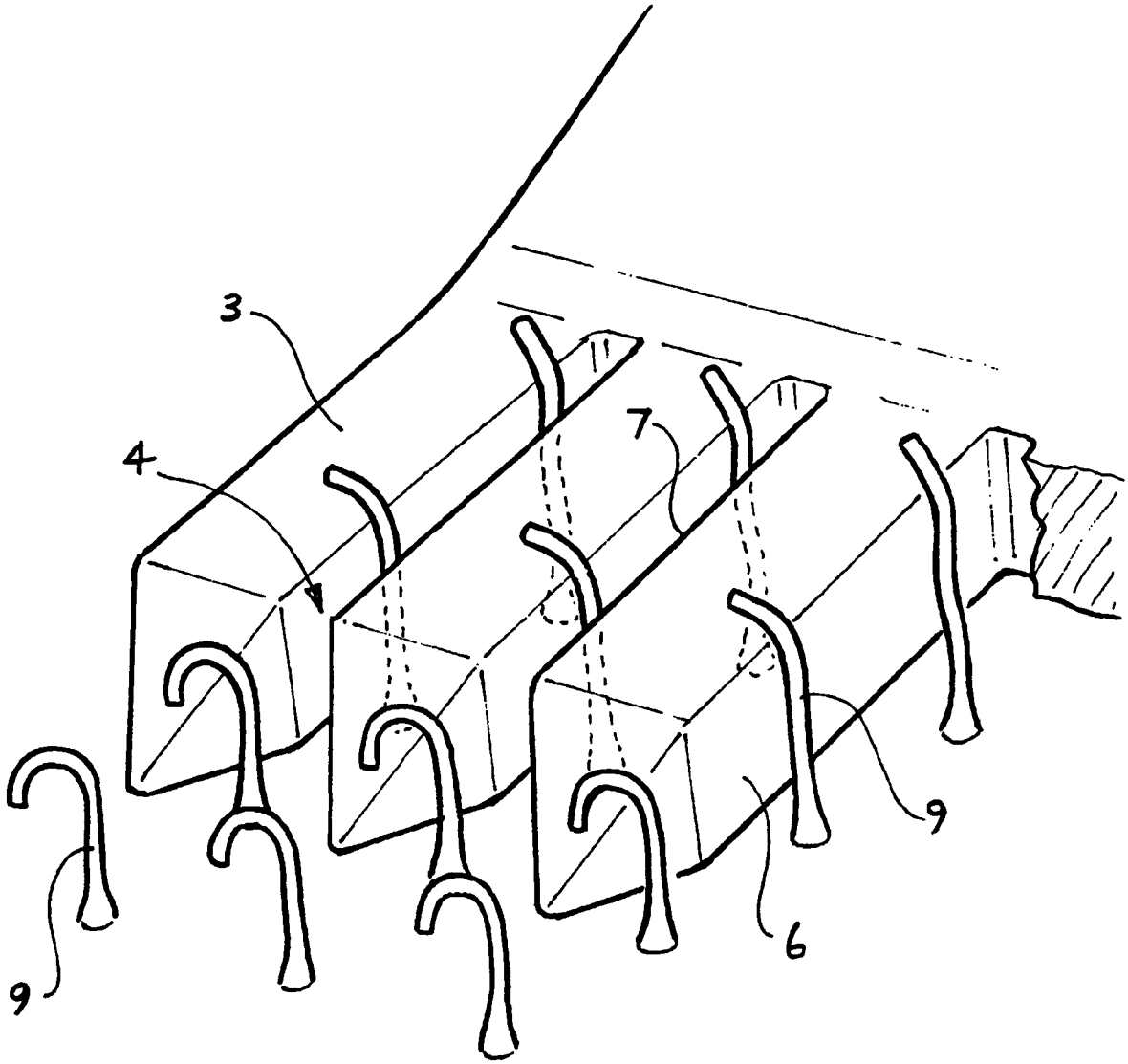
FIG. 7 is a detail perspective view, illustrating the way in which the embodiment is used with the hook side of a hook and loop attachment system.
Figure 8:
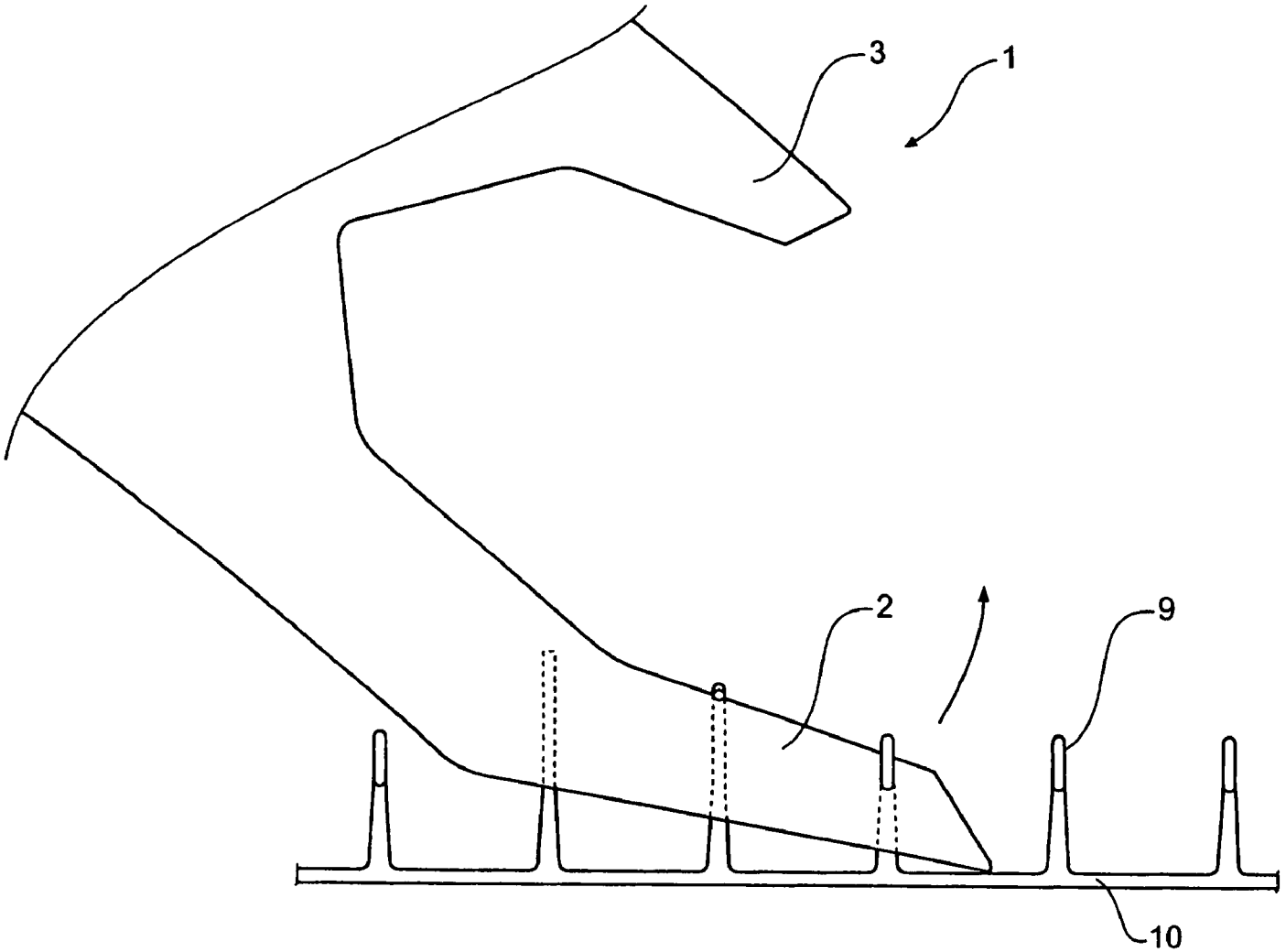
FIG. 8 is a detail side view, illustrating an alternative means in which the embodiment can be used with the hook side of a hook and loop attachment system.

Now referring to the drawings, there is shown a body 1 which is made from injection moulded plastics material.

The body 1 has two sets of fingers being a primary set 2 and a secondary set 3.

The fingers in both sets 2 and 3 are arranged so that they are aligned, one along side the other, leaving therebetween a slot shown typically at 4 in the one case and 5 in the other, so that there are therefore a plurality of these slots which are parallel one with respect to the other, in respect of each set.

Also, each finger has in the main sides typically shown at 6 and 7 which are parallel one to the other and also therefore the fingers themselves are parallel and are spaced apart an equal distance from one another.

The problem to which this invention is directed is a technique for being able to restore the hook portion of "Velcro" type connecting materials.

This material is shown typically at 8 where there are a plurality of stems 9 supported in a base 10 where each of the stems and the uppermost end of the stem which is bent into a hook shape, are aligned in rows where the hook portion extends relatively uniformly into the row and further, the stems are spaced apart in each row by a uniform distance.

This distance apart from center of one stem to a center of another is in a conventional system 0.8 mms (This can be otherwise within the range of from 0.7 mm to 0.9 mm). (This is, however, the one version and where the distance is different a different matching spacing of fingers will be appropriate selected).

The concept is to have each of the fingers 2 and 3 both spaced apart and of an individual thickness so that they will pass between respective stems of the hook shape members and, as well, match adjacent gaps between the hook material so that respective fingers will collectively be able to pass between adjacent stems and thereby collect debris including fibres that otherwise would be trapped and make the effect of the hook materials less useful.

Each finger has a lowermost narrow edge or sharper edge at its front or forward most.

This implicitly then provides for an inclined front face 2 so that as each finger is moved forwardly between the stems, there will be the ability for the leading lower sharper edge to get beneath any debris and therefore provide an effective lifting of this away from a base.

A further feature of each of the fingers is that a leading lower edge is also tapered from each side so that there will be the effect when the leading edge is pushed randomly against the rows of stems, each of the fingers will be caused to "center" between the stems by reason of this front taper, which is shown at 13.

The sharpness of the bottom edge and the degree of taper is chosen so that these are compatible with the material from which the body is moulded.

Some plastics material will be softer or will be subject to rapid wearing and the extent of taper and the sharpness of the lower edge are, in the first instance, as much as can be tolerated without undue weakening, in the case of the finger, the overall strength of the finger or, in the case of the lowermost edge, so that it will be expected to maintain the shape after at least a reasonable number of uses.

The feature of having two sets of fingers where a first set is positioned so that it can be in a leading position and there is the second set orientated approximately at a similar orientation with respect to the first, firstly has the effect of providing a second set of fingers which will catch partially lifted materials from the lifting effect of the first fingers.

It has been noticed that a single pass will often lift ends of fibres or tear materials and if a second set of fingers with the same pass and immediately behind the first is pushed through the hook materials, and in each case having the same tapered front and sharp lowermost leading edge, then the efficiency of the cleaning process using this device and method is improved significantly.

The depth of each respective slot between fingers is chosen so that there will be a sufficient clearance for respective stems with their uppermost hooks but is not intended to be very much longer so as to leave the greatest possible strength available to the material providing the body of the respective fingers.

Given that these are necessarily thin, and it is generally better that they are not unduly high in thickness which is defined by the distance apart of the respective stems, the ability to limit perhaps to a factor of two to three times the individual width of each finger is of advantage.

A remainder of the body 1 is shaped with a curve so as to be appropriate for holding between a finger and thumb as is shown where hand 15 is shown holding appropriately the body 1.

The body can be used in three different ways, one of which is to effect a lifting or scooping where the first set is positioned so as to be slightly inclined to a base and the following set of fingers will pick up lifted debris from the first set.

It is, however, possible to use the body with the fingers in an approximately vertical orientation so that it is used then as a final scraping of residual debris.

This is shown in the drawings.

The method then is to use such an apparatus in conjunction with the hook side of Velcro style materials in the manner disclosed.

While plastics material has been referred to as one material, it is also possible for this article to be made from any other appropriate material including metal which would have a longer life and would allow individual edges, especially forward sharper edges to be able to be maintained for longer during use.

While there has been described specific ways in which the member can be used and which is a most efficient way to use the member, the member as has been described can be used in different ways in connection with the hook material even though such alternate methods may not be the most efficient way.

The invention claimed is:

1. A method of restoring hook material used for hook and loop attachment, the hook material having stems arrayed thereupon with the stems each terminating in a hook, the method comprising the step of raking along a length of the hook material with a member having an arcuately curved handle with an elongated cross-section having a leading edge with a plurality of spaced teeth disposed in first and second rows extending along the cross-section, with the second row having elongated teeth angularly bent from the curve of the handle inwardly toward a plane defined by the teeth of the first row, and the first row having elongated teeth shorter than the teeth of the second row, wherein a. the width of each respective tooth, and b. the spacing apart of adjacent teeth, are such that adjacent hooks on the hook material have one of the teeth fit therebetween closely adjacent to their stems, and wherein the leading edge is raked along the length of the hook material to have the teeth engage and bend the hooks from a hooked state to a more straightened state such that debris situated within the hooks is lifted from the hook material by the teeth.

2. The method of claim 1 wherein the teeth are centered approximately 0.8 mm apart, with the widths and spacing of the teeth being such that each tooth engages at least a major portion of a surface area of the hook material between adjacent stems.

3. The method of claim 1 wherein the teeth are centered 0.7-0.9 mm apart, with the widths and spacing of the teeth being such that each tooth engages at least a major portion of a surface area of the hook material between adjacent stems.

4. The method of claim 1 wherein:

a. the spacings between adjacent teeth are equal to or slightly greater than the thickness of one of the stems, such that the teeth engage adjacent hooks and/or their stems, and b. the width of each tooth is equal to or slightly less than the distance between adjacent stems, such that each tooth engages at least a major portion of a surface area of the hook material between adjacent stems.

5. The method of claim 1 wherein at least one of the teeth has a wedge-shaped leading edge.

6. The method of claim 1 wherein at least one of the teeth terminates in a leading edge, and has a width which increases as the tooth extends rearwardly of the leading edge.

7. The method of claim 6 wherein the tooth has opposing sides with the leading edge therebetween, and wherein both sides incline away from the leading edge.

8. The method of claim 1 wherein the teeth in the second row are arrayed in echelon with the teeth in the first row.

9. An apparatus for restoring hook material used for hook and loop attachment, such hook material having thereupon an array of stems terminating in hooks, the apparatus being defined by a plastic rake with an elongated cross-section having an arcuately curved length sized to fit within a user's hand and including:

(1) a plurality of spaced teeth defined in a first discrete set extending across the cross-section wherein:

a. the width of each respective tooth, and b. the spacing apart of adjacent teeth, are sized to allow each tooth to closely pass between adjacent stems on the hook material, (2) a second discrete set of spaced teeth is provided spaced from the first set, and extending across the cross-section, wherein the teeth in the second set are:

a. sized and spaced similarly to the teeth in the first set, b. angularly bent from the curved length of the rake to extend toward a plane defined by the teeth in the first set, and c. longer than the teeth in the first set.

wherein each tooth includes a forward leading edge, and each tooth is tapered to increase in:

a. width, b. height, and c. thickness, as the tooth extends rearwardly of the leading edge, wherein raking the sets of spaced teeth along a length of hook material causes the teeth to engage and bend the hooks from a hooked state to a more straightened state such that debris situated within the hooks is lifted from the hook material by the teeth.

10. The apparatus of claim 9 wherein the teeth in the second discrete set are arrayed in echelon with the teeth in the first discrete set.

11. The apparatus of claim 9 wherein:

a. the rake further includes a handle from which the teeth extend, b. the sets of spaced teeth extend across the width of the handle at or adjacent one end of the length of the handle, and c. the handle has an at least substantially uniform width along the length of the handle.

12. An apparatus for restoring hook material used for hook and loop attachment, such hook material having thereupon an array of stems terminating in hooks, the apparatus being defined by a plastic rake sized to fit within the hand, and including:

a. an elongated handle having at least substantially uniform elongated width extending along the length of the handle, the length of the handle being arcuately curved, and b. first and second arrays of teeth extending from the handle, wherein the arrays of teeth extend across the width of the handle at or adjacent one end of the length of the handle, wherein the first and second arrays each define one or more rows of teeth, the rows in the first array, having teeth shorter than the teeth of the rows of the second array, and the rows in the second array having teeth angularly bent from the arcuate curve of the handle inwardly toward a plane defined by one of the rows of the first array, and wherein:

(1) each tooth within the arrays is sized to fit between adjacent stems of hook material, (2) adjacent teeth of each array are spaced to allow passage of one of the stems therebetween, and (3) the teeth within the rows of the first array are angled differently from the teeth within the rows of the second array, wherein the teeth are sized, spaced, and angled such that raking the sets of spaced teeth along a length of hook material causes the teeth to engage and bend the hooks from a hooked state to a more straightened state, and thereby lift debris situated within the hooks.

13. The apparatus of claim 12 wherein the first array and second array are spaced by a toothless valley.

14. The apparatus of claim 12 wherein the teeth of the second array are set in echelon with the teeth of the first array.

15. The apparatus of claim 12 wherein at least one of the arrays includes tapered teeth, wherein each tapered tooth grows thicker in at least one dimension as the tapered tooth extends rearwardly from the leading edge of the tapered tooth.

16. The apparatus of claim 15 wherein each tapered tooth is axially symmetric in at least one plane defined along an axis extending rearwardly from the leading edge of the tapered tooth.

17. The apparatus of claim 16 wherein at least one of the arrays includes tapered teeth, wherein each tapered tooth grows thicker in at least one dimension as the tapered tooth extends rearwardly from its leading edge.

18. The method of claim 8 wherein the teeth in the second line are angled in non-parallel relationship with the teeth in the first line.

* * * * *